US011253920B2

(12) United States Patent
Chen et al.

(10) Patent No.: US 11,253,920 B2
(45) Date of Patent: Feb. 22, 2022

(54) METHOD FOR PREPARATION OF COPPER NANOCUBES UTILIZING TRIBUTYLPHOSPHINE AS A LIGAND

(71) Applicant: HONDA MOTOR CO., LTD., Tokyo (JP)

(72) Inventors: Gugang Chen, Palo Alto, CA (US); Shutang Chen, San Jose, CA (US)

(73) Assignee: HONDA MOTOR CO., LTD., Tokyo (JP)

( * ) Notice: Subject to any disclaimer, the term of this patent is extended or adjusted under 35 U.S.C. 154(b) by 259 days.

(21) Appl. No.: 16/525,097

(22) Filed: Jul. 29, 2019

(65) Prior Publication Data

US 2021/0031271 A1 Feb. 4, 2021

(51) Int. Cl.
*B22F 9/24* (2006.01)
*B22F 1/00* (2022.01)

(52) U.S. Cl.
CPC ..... *B22F 9/24* (2013.01); *B22F 1/0018* (2013.01); *B22F 2001/0037* (2013.01); *B22F 2301/10* (2013.01); *B22F 2304/054* (2013.01)

(58) Field of Classification Search
None
See application file for complete search history.

(56) References Cited

U.S. PATENT DOCUMENTS

2010/0065616 A1* 3/2010 Zinn ..... B22F 1/025 228/249
2011/0240716 A1* 10/2011 Zinn ..... B23K 3/029 228/119
2013/0248775 A1* 9/2013 Kurihara ..... B22F 1/0018 252/512

FOREIGN PATENT DOCUMENTS

CN 107159900 A * 9/2017

OTHER PUBLICATIONS

English translation of CN 107159900 (originally published Sep. 15, 2017), obtained from Espacenet.*
Christopher Hahn et al., "Engineering Cu surfaces for the electrocatalytic conversion of CO2: Controlling selectivity toward oxygenates and hydrocarbons", PNAS, vol. 114, No. 23, pp. 5918-5923, Jun. 6, 2017.
Hong-Jie Yang et al., "Monodisperse Copper Nanocubes: Synthesis, Self-Assembly, and Large-Area Dense-Packed Films", American Chemical Society, Chemistry of Materials, 26, pp. 1785-1793, (2014).
Huizhang Guo et al., "Shape-Selective Formation of Monodisperse Copper Nanospheres and Nanocubes via Disproportionation Reaction Route and Their Optical Properties", The Journal of Physical Chemistry C, 118, pp. 9801-9808, (2014).
Yihai Wang et al., "Synthesis of well-defined copper nanocubes by a one-pot solution process", Institute of Physics Publishing, Nanotechnology 17, pp. 6000-6006, (2006).
Zewei Quan et al., "High-Index Faceted Nobie Metal Nanocrystals", Acccunts of Chemical Research, vol. 46, No. 2, pp. 191-202, (2013).

* cited by examiner

*Primary Examiner* — George Wyszomierski
(74) *Attorney, Agent, or Firm* — Arent Fox LLP

(57) ABSTRACT

A method for preparing copper nanocubes with specific facets and uniform size, the method comprising combining a copper complex solution in a reaction mixture with a ligand. Using a ligand of pure, unoxidized tributylphosphine, uniform copper nanocubes with six facets are prepared.

13 Claims, 7 Drawing Sheets

METHOD FOR PREPARATION OF COPPER NANOCUBES UTILIZING TRIBUTYLPHOSPHINE AS A LIGAND

TECHNICAL FIELD

The present disclosure is directed to a method for preparation of copper nanocubes.

BACKGROUND

The reduction of carbon dioxide using various catalysts has gained great interest due to the potential to produce fuels and chemicals in a sustainable manner. In light of concerns of global warming, carbon dioxide has garnered attention as a renewable resource. Metal nanostructures with various features have shown excellent catalytic performance for carbon dioxide reduction reactions. Using copper nanostructures, reduction of carbon dioxide can be utilized to produce various chemical products, while the surfaces of the nanostructures can affect various aspects of the catalytic process. The structure of various copper nanocubes can vary depending upon the methods and conditions used for production. Accordingly, specific methods of producing copper nanocubes have gained interest because of the potential ability to tailor subsequent catalytic reactions using pre-designed features of the nanocubes. Currently, a few methods have been developed to synthesize copper nanocubes. However, their formation mechanism is unclear and the reproducibility of copper nanocube formation needs to be improved. As such, there is a need in the art for an effective and efficient method of preparing copper nanocubes with predictable features.

SUMMARY

The present disclosure is directed to a reproducible method of synthesizing copper nanocubes with certain index facets, the method using tributylphosphine (TBP) as a ligand. If impure or oxidized tributylphosphine is used as a ligand, the copper nanostructures will comprise polyhedral nanostructures. According to some aspects, copper nanosheets can be synthesized by utilizing trioctylphosphine (TOP) as a ligand in the method. Copper nanostructures with controlled facets demonstrate superior catalytic performance for oxygen reduction reactions, carbon dioxide reduction reactions, and hydrogen evolution. Theoretical studies find that copper terraces are more catalytically active and selective for C—C coupling than flat copper. Copper nanocubes with six facets are regarded as one of the most active catalysts for carbon dioxide reduction. In some embodiments, unoxidized tributylphosphine is utilized as the ligand to synthesize uniform copper nanocubes with an average size of 38.4 nm. Experimental results indicate that tributylphosphine purity and reaction temperature play critical roles for the formation of the cube-shape of copper nanocubes. Even trace oxidation of tributylphosphine will affect the formation of copper nanocubes. Compared to other methods reported in the literature, the presence of pure or highly pure tributylphosphine in this method not only improves the synthetic reproducibility but also clarifies the cube-shape formation mechanism. Moreover, the copper nanocubes produced by the method disclosed herein demonstrate superior activity and selectivity for carbon dioxide reduction reactions. This disclosure is also directed to copper nanocubes and nanostructures provided by the method described herein and devices comprising the copper nanocubes and nanostructures provided by the method described herein, as well as methods of using the same.

DETAILED DESCRIPTION

Figure 7:
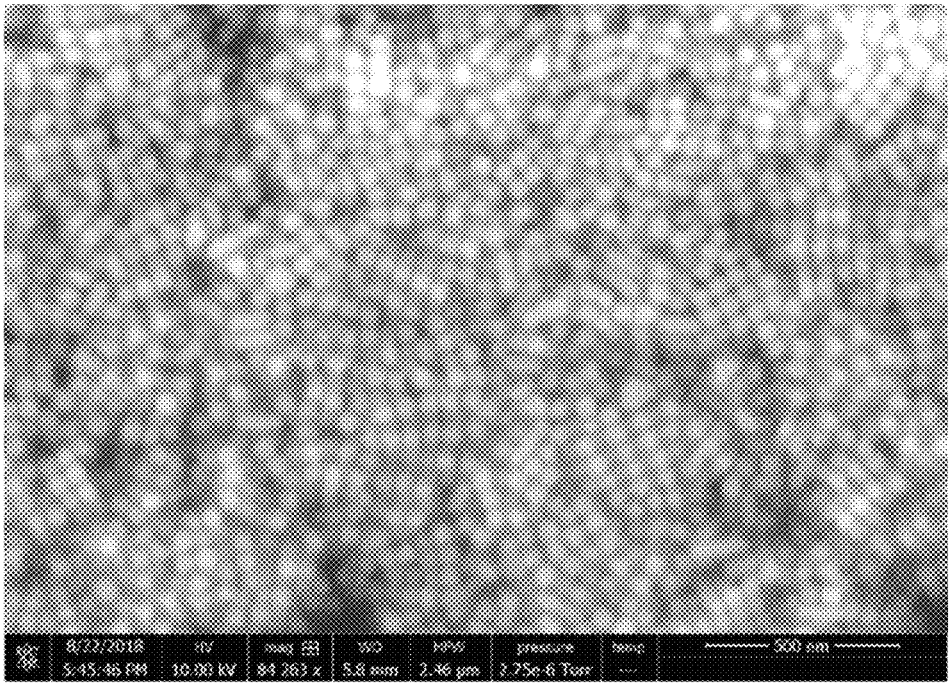
FIG. 7 shows an SEM image of copper nanostructures prepared using a sealed tributylphosphine bottle in air, with the bottle freshly opened for use.
Figure 9:
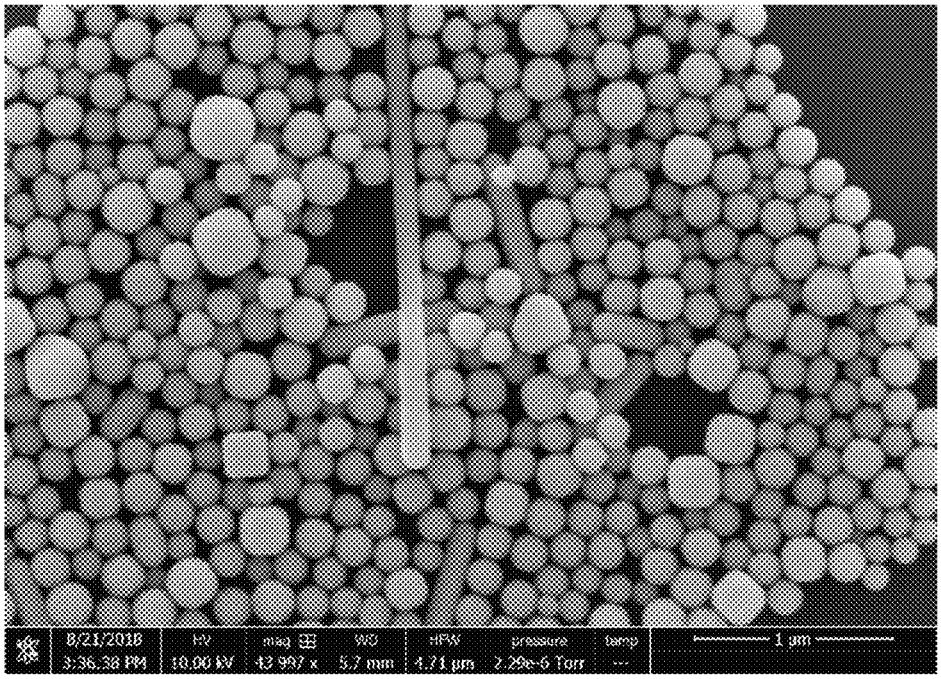
FIG. 9 shows an SEM image of copper nanostructures prepared using the previously unsealed tributylphosphine bottle in air, 20 days after the bottle was opened for use.

The present disclosure is directed to a method for preparing copper nanocubes and copper nanostructures. In some embodiments, the method can comprise preparation of a copper complex solution. According to some aspects, the copper complex solution is combined with a hot reaction mixture under an inert atmosphere, for example, by hot-injection. The hot reaction mixture contains a ligand. The copper nanostructures subsequently form in the hot reaction mixture. If the hot reaction mixture comprises pure, unoxidized tributylphosphine as the ligand, the copper nanostructures will comprise uniform copper nanocubes (FIG. 7). If the hot reaction mixture comprises oxidized tributylphosphine as the ligand, the copper nanostructures will comprise polyhedral nanostructures (FIG. 9). According to some aspects, the high purity and unoxidized state of the tributylphosphine ligand enable preparation of copper nanocubes comprising consistent or uniform cube-shape with exposed six facets.

As used herein, the term "nanostructure" refers to a structure having at least one dimension on the nanoscale, that is, at least one dimension between about 0.1 and 100 nm. It should be understood that "nanostructures" include, but are not limited to, nanosheets, nanotubes, nanoparticles (e.g., polyhedral nanoparticles), nanospheres, nanowires, nanocubes, and combinations thereof. A nanosheet may comprise a sheet having a thickness on the nanoscale. A nanowire may comprise a wire having a diameter on the nanoscale. A nanoparticle may comprise a particle wherein each spatial dimension thereof is on the nanoscale.

The copper complex solution may comprise one or more copper complexes. As used herein, the term "copper complex" refers to a complex of copper and one or more complexing agents. Complexing agents useful according to the present disclosure include, but are not limited to, tetradecylamine (TDA), dodecylamine (DDA), hexadecylamine (HAD), octadecylamine (ODA), and oleylamine (OLA). According to some aspects, the copper complex may be provided by combining one or more copper atoms or copper salts with one or more complexing agents in a solution under an inert atmosphere and stirring for an acceptable length of time at an acceptable temperature. For example, the copper complex may be provided by combining a copper salt and one or more complexing agents in a solution under an inert gas flow. Examples of inert gases include, but are not limited to, nitrogen gas, argon gas, and combinations thereof. The combined solution may then be heated to a temperature of between about 100 and 300° C. for about 10 minutes, or about one minute to about one hour, or preferably about 5 minutes to 45 minutes, or preferably about 6 minutes to 30 minutes, or preferably about 8 minutes to 15 minutes, or preferably about 9 minutes to 11 minutes, to provide a copper complex solution comprising the copper complex.

In some embodiments, the copper complex solution includes copper (I) chloride in an amount of about 5% by weight, or about 2.5% to 25% by weight, or more preferably about 3% to 15% by weight, or more preferably about 4% to 10% by weight, or even more preferably about 4% to 6% by weight. Inclusion of copper (I) chloride in an amount of the foregoing ranges provided copper for synthesis while enabling optimization of synthetic conditions.

According to some aspects, the copper nanostructures may be provided by heating the copper complex solution with a ligand. For example, the copper nanostructures may be provided by combining the copper complex solution with one or more ligands at an elevated temperature under an inert atmosphere for an acceptable length of time. For example, the copper nanostructures may be provided by combining the copper complex solution with a ligand under an inert atmosphere at an elevated temperature of between about 100 and 500° C., optionally between about 200 and 400° C., optionally between about 250 and 350° C., optionally between about 275 and 325° C., optionally between about 295 and 305° C., and optionally about 300° C. The combined solution may be held at the elevated temperature for a time of between about 1 minute and 2 hours, optionally between about 1 minute and 1 hour, optionally between about 1 minute and 35 minutes, optionally between about 1 minute and 5 minutes, optionally between about 2 minutes and 4 minutes, optionally between about 20 minutes and 40 minutes, optionally between about 25 minutes and 35 minutes, or optionally between about 29 minutes and 31 minutes, to provide a copper nanostructure solution containing the copper nanostructures. Examples of ligands include, but are not limited to tributylphosphine, tributylphosphine oxide, trioctylphosphine, trioctylphosphine oxide, oleylamine, tetradecylamine, dodecylamine, octadecylamine, hexadecylamine, oleic acid, and combinations thereof.

According to some aspects, a method for preparing copper nanostructures is provided herein, the method comprising: providing a copper complex solution comprising copper and a first complexing agent; preparing a reaction mixture comprising a ligand by heating the reaction mixture under inert atmosphere; combining the copper complex solution and the reaction mixture at a reaction temperature under inert atmosphere; holding the reaction mixture at the reaction temperature for a reaction time under inert atmosphere; cooling the reaction mixture; and isolating the copper nanostructures.

The copper complex solution may be combined with the reaction mixture by injecting the copper complex solution into the reaction mixture under inert atmosphere, and a hot-injection may be used to combine.

The method is according to some aspects, wherein the ligand is unoxidized tributylphosphine, the reaction temperature is 250 to 350° C., the reaction time is 20 to 40 minutes, and the copper nanostructures comprise copper nanocubes. Optionally, the ligand is unoxidized tributylphosphine, wherein the reaction temperature is 300° C., the reaction time is 30 minutes, and the copper nanostructures comprise copper nanocubes having an average size of 38.4±2.7 nm. As used herein, the size of a copper nanocube is defined as the length along one edge of the cube. If a copper nanocube has substantial deviations from a cube shape, the average length of the edges of the cube can be utilized to define the size, or, for example, one or more aspect ratios can be used in combination with the length of one edge.

Figure 8:
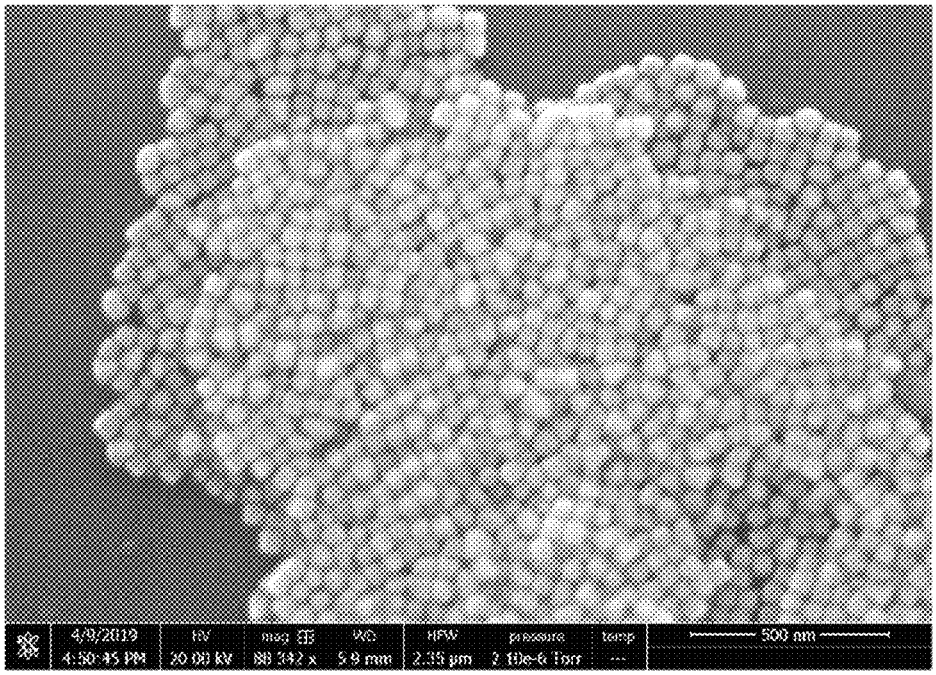
FIG. 8 shows an SEM image of copper nanostructures prepared using the previously unsealed tributylphosphine bottle in air, 7 days after the bottle was opened for use.

According to some aspects, the ligand is highly pure and unoxidized tributylphosphine and wherein the high purity and unoxidized properties of the tributylphosphine enable the preparation of copper nanocubes comprising uniform cube-shape (FIGS. 7-9). As used herein, the terms "highly pure" and "high purity" are defined as about 98-100%, 99-100%, 99.9-100%, 99.99-100%, or 99.999%-100% pure.

As used herein, the terms "uniform", "uniform size", and "uniform shape" are defined as remaining the same in all cases and at all times; unchanging in form or character; provided the same reactants and same reaction conditions, with minimal or defined variation. It should be noted that the methods described herein can provide nanocubes having a uniform cube shape, with the aspect ratio of a cube defined as the ratio of the length to the width or the ratio of the length to the height, a cube having an aspect ratio of 1, with deviations from cubic shape demonstrated by an aspect ratio, either length/width or length/height, other than 1. Under the same reaction conditions, the aspect ratio of the nanocubes provided by the methods herein can be about 1±90%, 1±80%, 1±70%, 1±60%, 1±50%, 1±40%, 1±30%, 1±20%, 1±10%, 1±5%, 1±2.5, or 1±1%.

According to some aspects, the method is wherein the ligand is trioctylphosphine, the reaction temperature is 250 to 350° C. or 300° C., the reaction time is 1 to 5 minutes or 3 minutes, and the copper nanostructures comprise copper nanosheets.

According to some aspects, the copper complex solution is provided by heating a mixture comprising copper (I) chloride, tetradecylamine, and 1-octadecene to a temperature from 100 to 300° C. under inert atmosphere for a time from 1 to 60 minutes. Optionally, the temperature is 200° C. and the time is 10 minutes.

The method is according to some aspects, wherein preparing a reaction mixture further comprises preparing a reaction mixture comprising a second complexing agent, for example, oleylamine, and a ligand by heating the reaction mixture under inert atmosphere.

In some embodiments, the method can be wherein the ligand comprises unoxidized tributylphosphine, the reaction temperature is 300° C., the reaction time is 60 minutes, and the copper nanostructures comprise copper nanowires.

According to some aspects, the methods described herein can provide copper nanocubes having an average size from about 20 to 60 nm, optionally about 30 to 50 nm, optionally about 35 to 45 nm. According to some aspects, copper nanocubes having an average size of 38.4±2.7 nm are provided, wherein the copper nanocubes are more catalytically efficient for C—C coupling than copper nanosheets in $CO_2$ reduction reactions. Copper nanocubes less than 20 nm are easily oxidized if exposed to oxygen, for example, during an isolation step at ambient conditions. According to some aspects, the methods disclosed herein can be followed under a controlled environment without oxygen, for example, using an inert-gas environment. Non-oxidizing techniques are known in the art and non-limiting examples are to utilize a glove box purged with inert gas or to utilize a process-chemistry reaction system purged with inert gas, thereby protecting copper nanocubes less than 20 nm from oxidation. In some embodiments, without oxidation, the methods disclosed herein can provide copper nanocubes having an average size from about 1 to 20 nm, optionally about 5 to 20 nm, optionally about 10 to 20 nm, and optionally about 15 to 20 nm.

According to some aspects, a system for reduction of $CO_2$ is disclosed, the system comprising copper nanocubes having an average size of 38.4±2.7 nm, wherein the system is selective for C—C coupling during reduction of $CO_2$.

According to some aspects, the ligand comprises impure or oxidized tributylphosphine, the reaction time is 30 minutes, and the copper nanostructures comprise polyhedral nanostructures.

According to some aspects, the copper nanostructures are isolated by adding hexane or another hydrophobic solvent such as toluene and chloroform, centrifuging, and discarding the supernatant.

According to some aspects, the method may further comprise one or more washing steps. The washing step may comprise centrifuging the solution containing the nanostructures, removing the supernatant, combining with a solvent, for example, a hydrophobic solvent or an organic solvent, and centrifuging the combined solution. The method may comprise one, two, three, or more washing steps.

According to some aspects, the method may comprise a one-step synthetic strategy. As used herein, the term "one-step synthetic strategy" refers to a synthetic strategy wherein at least a first reactant is converted to a reaction product in a single synthesis step. For example, as described herein, the copper complex solution may be converted to copper nanocubes in a single synthesis step, in particular, provided the ligand and reaction conditions herein.

The disclosure is also directed to copper nanostructures provided by the method described herein and devices comprising the copper nanostructures provided by the method described herein, as well as methods of using the same.

Examples of copper sources include, but are not limited to, copper (I) chloride, copper (I) bromide, and copper (I) acetate.

Figure 1:
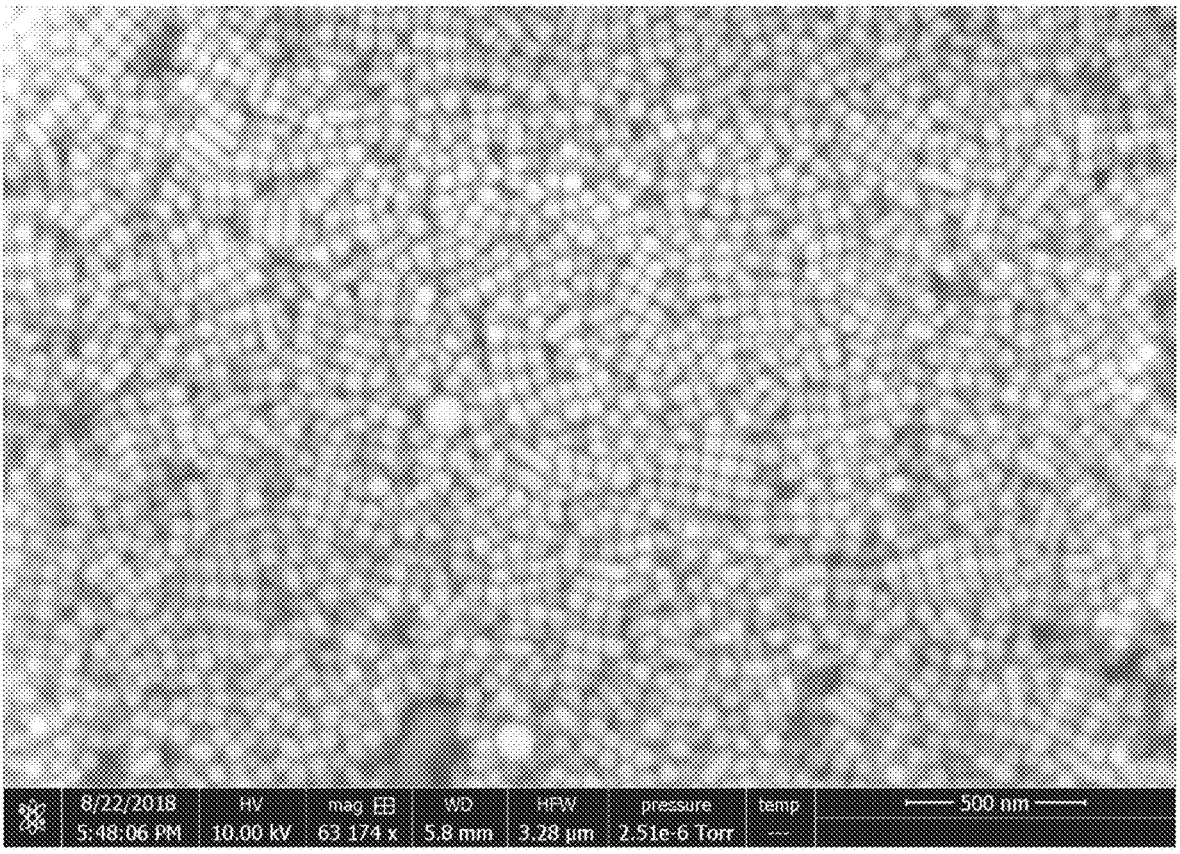
FIG. 1 shows a low magnification scanning electron microscope (SEM) image of copper nanocubes prepared according to Example II.
Figure 2:
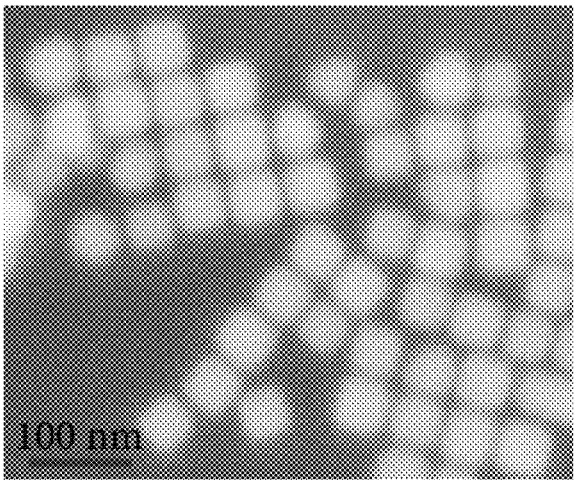
FIG. 2 shows a high magnification scanning electron microscope (SEM) image of copper nanocubes prepared according to Example II.
Figure 3:
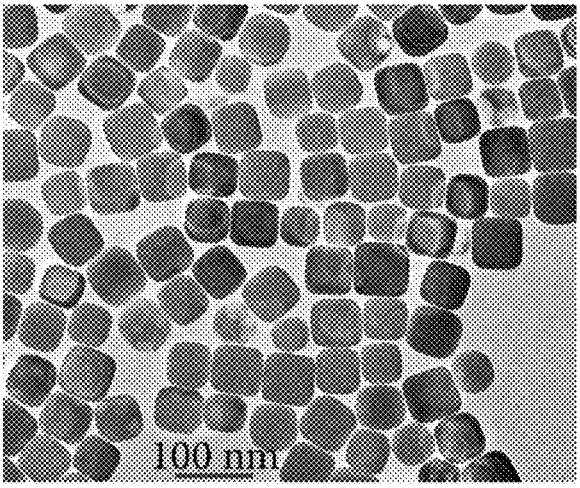
FIG. 3 shows a transmission electron microscopy (TEM) image of copper nanocubes prepared according to Example II.
Figure 4:
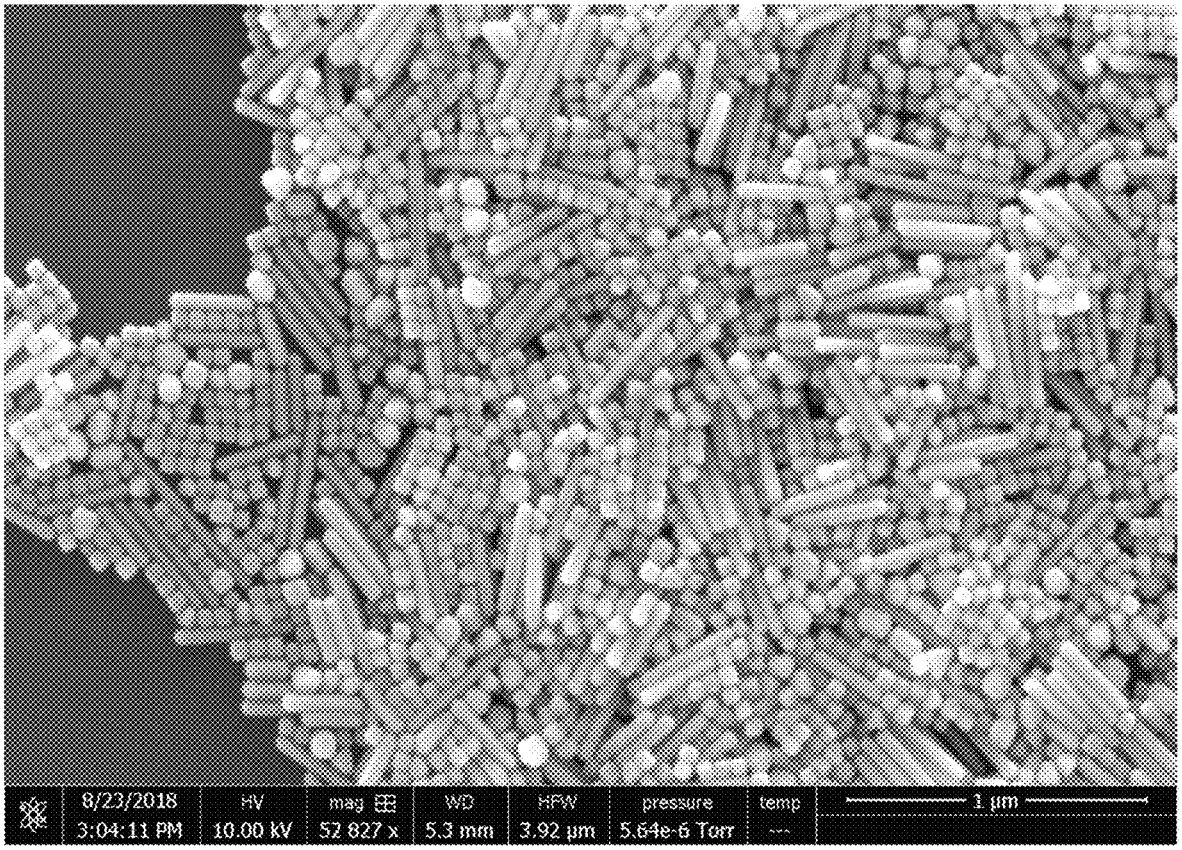
FIG. 4 shows a scanning electron microscope (SEM) image of copper nanocubes and copper nanowires prepared at 300° C. for 60 minutes.

In the presently disclosed method, uniform copper (Cu) nanocubes were synthesized at 300° C. for a reaction time of 30 minutes, as shown in FIGS. 1-3. The low magnification SEM image (FIG. 1) indicated more than 95% of the nanoparticles are cube-shape. High magnification SEM and TEM images (FIGS. 2-3) indicated the average size of the Cu nanocubes was 38.4±2.7 nm. With the reaction time prolonged to 60 minutes, besides Cu nanocubes, Cu shorter nanowires were also obtained as by-products, as shown in FIG. 4. Smaller Cu nanocubes may be prepared at shorter reaction intervals (less than 10 min.), however, they were easily oxidized during the purification process.

Figure 5:
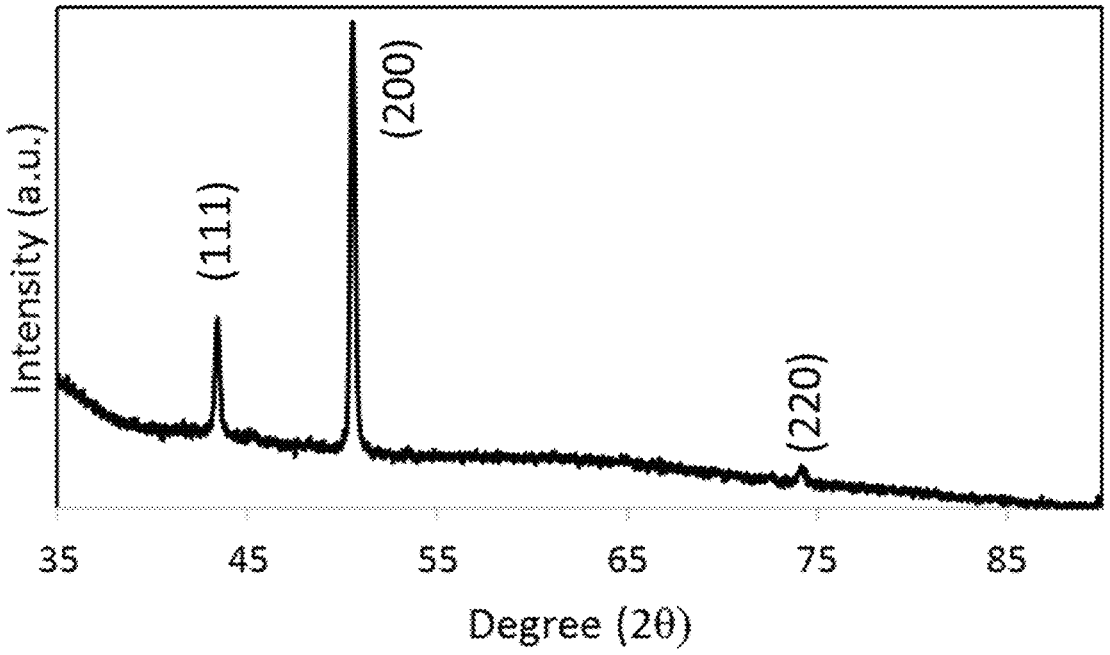
FIG. 5 shows an XRD pattern of copper nanocubes.

FIG. 5 shows X-ray diffraction (XRD) patterns of the Cu nanocubes. Cu nanocubes had {111}, {200}, {220} diffraction peaks, which were consistent with face centered cubic (fcc) bulk Cu (Joint Committee on Powder Diffraction Standards, JCPDS 03-1018, XRD peaks are annotated in { }). Cu {111} is the strongest diffraction peak in the traditional bulk Cu phase. However, we found the Cu {200} peak was the strongest peak in cube-shape phase. Here we should emphasize the XRD sample was prepared by drying the Cu nanocubes' solution on a glass slide at room temperature. As a result, almost all of the Cu nanocubes have a preferred orientation with {200} facets parallel to the glassy substrate.

Figure 6:
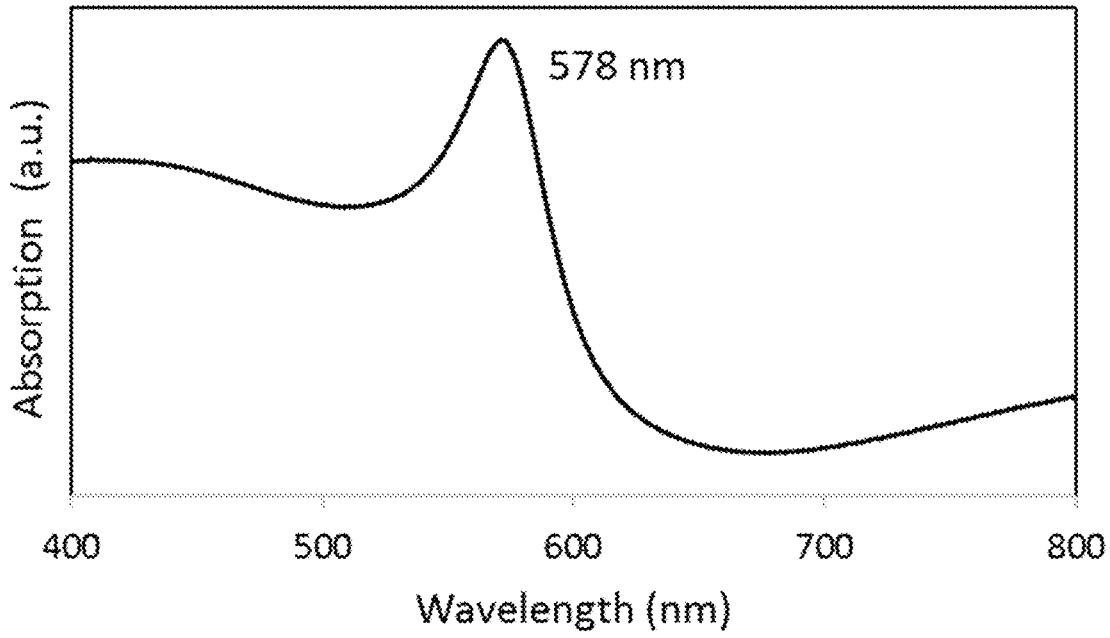
FIG. 6 shows a UV-V is absorption spectrum of a dispersion of copper nanocubes in hexane.

The as-synthesized Cu nanocubes exhibited a red color, which suggests the presence of copper. FIG. 6 shows the UV-Vis spectrum of a dispersion of the Cu nanocubes in hexane. The absorption peak of Cu nanocubes was centered at 578 nm. The peak position will be blue-shifted or red-shifted with decreasing or increasing sizes of Cu nanocubes, respectively.

We also investigated the effect of tributylphosphine (TBP) purity on the formation of cube-shape. The storage of TBP in a glove box can avoid or reduce the oxidation of TBP. Uniform Cu nanocubes were synthesized when the sealed TBP bottle was exposed in air less than 10 days, as shown in FIGS. 7-8. Cu polyhedral nanoparticles with mixed nanocubes were obtained when the TBP bottle was in air for 20 days or more (FIG. 9). Thus, for our present method, pure TBP is helpful to form a cube-shape, while TBP with partial oxidation will lead to the formation of polyhedral nanostructures. The reaction temperature also plays an important role for the formation of Cu nanocubes. At higher reaction temperature (300° C.), it only took 10 minutes to form Cu nanocubes, while it would take a few hours to obtain Cu nanocubes at lower reaction temperature (240° C.).

Figure 10:
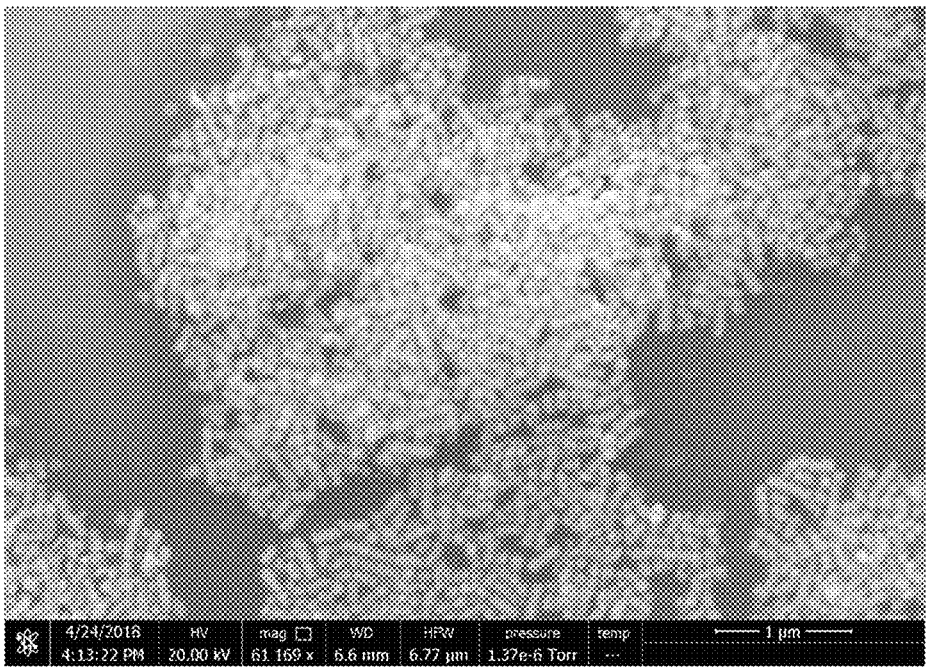
FIG. 10 shows an SEM image of copper nanosheets prepared according to Example III.
Figure 11:
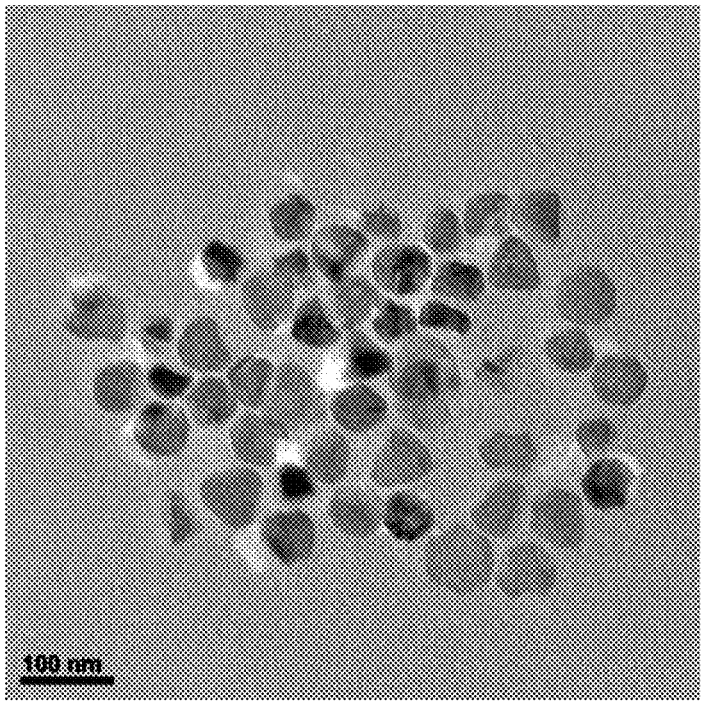
FIG. 11 shows a TEM image of copper nanosheets prepared according to Example III.
Figure 13:
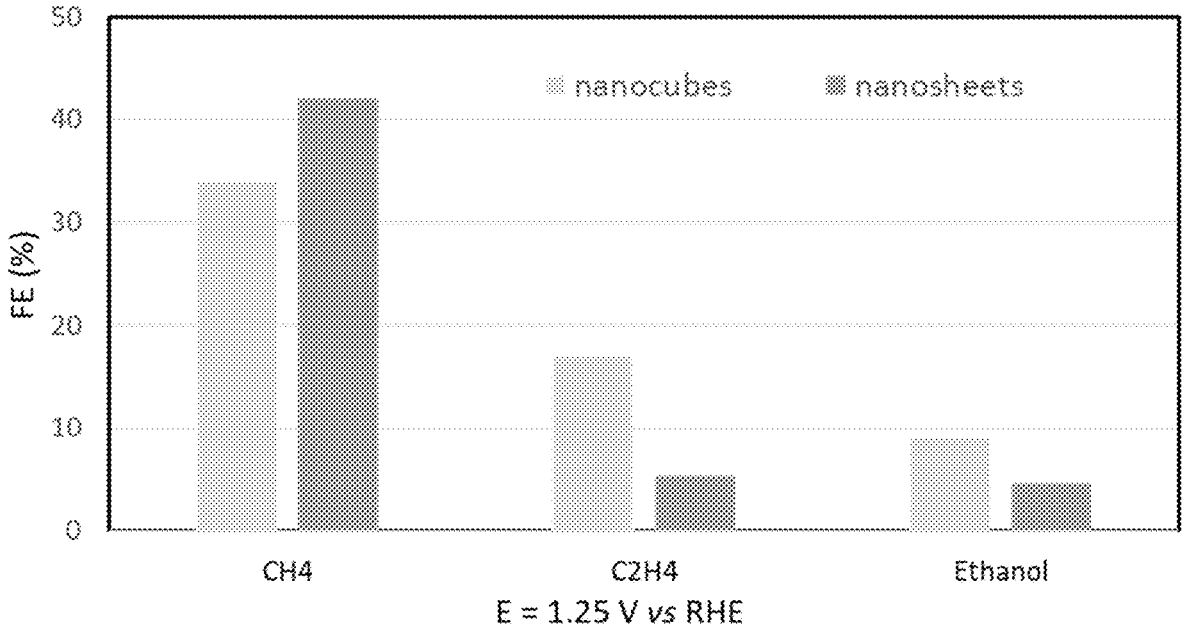
FIG. 13 shows a comparison of catalytic performance of copper nanocubes and copper nanosheets as catalysts for a $CO_2$ reduction reaction.

To evaluate the effect of surface facet of Cu nanostructures on catalytic performance, Cu nanocubes and Cu nanosheets (FIG. 10) were choosen as $CO_2$ reduction catalysts; they were loaded onto glassy carbon to serve as working electrodes. FIG. 13 shows the faradic efficiency (FEs) of $CH_4$, $C_2H_4$, and ethanol products at 1.25 V vs. RHE. Cu nanosheets with exposed {111} facets are selective to $CH_4$ products, which can reach the maximum FE of 42%; while Cu nanocubes with {200} facets are not only selective to $CH_4$ (34%), but also selective to $C_2H_4$ (17%) and ethanol (9%). The FEs of $C_2H_4$ and ethanol are almost three and two times higher than that of nanosheets, respectively. Theoretical studies find that Cu {200} terraces are more active and selective for C—C coupling than Cu {111}. Thus, our catalytic results were consistent with the theoretical analysis.

Cu nanocubes have been synthesized by employing TBP as a ligand at 300° C. The SEM results indicated the purity of TBP played critical roles for the formation of cube-shape. Cu nanocubes showed a unique XRD pattern due to surface {200} facets parallel to the glassy substrate. The dispersion of Cu nanocubes in hexane showed an absorption peak at 578 nm. Moreover, Cu nanocubes as catalysts for $CO_2$ reduction reaction demonstrated excellent catalytic activity and selectivity towards $C_2$ (C—C) products. We envision the current synthetic method can be extended to prepare other inorganic nanocubes.

As used herein, the term "catalyst" refers to a component that directs, provokes, or speeds up a chemical reaction, for example, the reduction of carbon dioxide. Examples of catalysts useful according to the present disclosure include, but are not limited to, copper nanocubes, synthetic ligands, and copper nanosheets.

Examples of inert gases useful according to the present disclosure include, but are not limited to, gases comprising helium (He), radon (Rd), neon (Ne), argon (Ar), xenon (Xe), nitrogen (N), and combinations thereof.

The present disclosure is also directed to systems or devices comprising the copper nanocubes and nanostructures prepared according to the methods described herein. For example, the device may comprise copper nanocubes in a catalyst, the device may comprise an electrode (such as an electrode for a battery) in a vessel, among others.

The present disclosure is also directed to methods of using the copper nanocubes and nanostructures prepared according to the methods described herein. For example, the method may comprise preparing a device as described herein comprising the copper nanocubes. For example, the method may comprise preparing a device comprising the copper nanocubes for a reduction of carbon dioxide.

This detailed description uses examples to present the disclosure, including the preferred aspects and variations, and also to enable any person skilled in the art to practice the disclosed aspects, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Aspects from the various embodiments described, as well as other known equivalents for each such aspect, can be mixed and matched by one of ordinary skill in the art to construct additional embodiments and techniques in accordance with principles of this application.

While the aspects described herein have been described in conjunction with the example aspects outlined above, various alternatives, modifications, variations, improvements, and/or substantial equivalents, whether known or that are or may be presently unforeseen, may become apparent to those having at least ordinary skill in the art. Accordingly, the example aspects, as set forth above, are intended to be illustrative, not limiting. Various changes may be made without departing from the spirit and scope of the disclosure. Therefore, the disclosure is intended to embrace all known or later-developed alternatives, modifications, variations, improvements, and/or substantial equivalents.

Reference to an element in the singular is not intended to mean "one and only one" unless specifically so stated, but rather "one or more." All structural and functional equivalents to the elements of the various aspects described throughout this disclosure that are known or later come to be known to those of ordinary skill in the art are expressly incorporated herein by reference. Moreover, nothing disclosed herein is intended to be dedicated to the public.

Further, the word "example" is used herein to mean "serving as an example, instance, or illustration." Any aspect described herein as "example" is not necessarily to be construed as preferred or advantageous over other aspects. Unless specifically stated otherwise, the term "some" refers to one or more. Combinations such as "at least one of A, B, or C," "at least one of A, B, and C," and "A, B, C, or any combination thereof" include any combination of A, B, and/or C, and may include multiples of A, multiples of B, or multiples of C. Specifically, combinations such as "at least one of A, B, or C," "at least one of A, B, and C," and "A, B, C, or any combination thereof" may be A only, B only, C only, A and B, A and C, B and C, or A and B and C, where any such combinations may contain one or more member or members of A, B, or C.

Herein, the recitation of numerical ranges by endpoints (e.g. 50 mg to 600 mg, between about 100 and 500° C., between about 1 minute and 60 minutes) include all numbers subsumed within that range, for example, between about 20 minutes and 40 minutes includes 21, 22, 23, and 24 minutes as endpoints within the specified range. Thus, for example, ranges 22-36, 25-32, 23-29, etc. are also ranges with endpoints subsumed within the range 20-40 depending on the starting materials used, specific applications, specific embodiments, or limitations of the claims if needed. The Examples and methods disclosed herein demonstrate the recited ranges subsume every point within the ranges because different synthetic products result from changing one or more reaction parameters. Further, the methods and Examples disclosed herein describe various aspects of the disclosed ranges and the effects if the ranges are changed individually or in combination with other recited ranges.

As used herein, the term "about" and "approximately" are defined to being close to as understood by one of ordinary skill in the art. In one non-limiting embodiment, the term "about" and "approximately" are defined to be within 10%, preferably within 5%, more preferably within 1%, and most preferably within 0.5%.

EXAMPLES

Example I

Preparation of Cu-TDA Precursor Complex Solution

Copper chloride (99.0%), tributylphosphine (TBP, 99%), trioctylphosphine (TOP, 97%), oleylamine (OLA, 70%), toluene (99.9%), acetone (99%), and chloroform (99.9%), and 1-octadecene (ODE, 98%) were purchased from Sigma-Aldrich. Tetradecylamine (TDA, >96%) was purchased from Tokyo Chemical Industry Co., Ltd. (TCI). Hexane (99%), methanol (99%), and ethanol (200 proof) were purchased from Fisher Chemicals. All chemicals were used as received unless described otherwise.

100 mg of copper (I) chloride (1.0 mmol), 240 mg of TDA, and 2 mL of ODE were added into a flask under Ar or $N_2$ flow. After Ar or $N_2$ blowing for 20 minutes, the mixed solution was heated to 200° C. and kept at this temperature for 10 minutes. The amounts of copper (I) chloride may vary from 50 mg to 600 mg, while the amounts of TDA and TBP increase from 120 mg to 1.44 g and from 0.5 mL to 6.0 mL, respectively. The complex solution can also be prepared by replacing TDA with OLA, hexadecylamine (HAD) or octadecylamine (ODA).

Example II

Synthesis of Cu Nanocubes 6.0 mL of oleylamine (OLA, 70%) was loaded in a 25 mL three-neck flask where oxygen was removed through Ar blowing for 20 minutes. Then 1.0 mL of tributylphosphine (TBP, 4.0 mmol) was injected into the flask under Ar flow. After 20 minutes of Ar flowing, the flask was put into the heating mantle with a temperature controller and rapidly heated to 300° C. at a heating rate of 15-25° C./min. Next, 2 mL of Cu-TDA complex solution was quickly injected into the hot flask and the reaction solution turned to red. The reaction was held at 300° C. for 30 minutes. The reaction solution was then cooled naturally to room temperature and 5 mL of hexane (or another hydrophobic solvent such as toluene and chloroform) was injected. The products were separated by centrifuging at 8000 rpm for 5 minutes. The supernatant was discarded. 10 mL of hexane was then added to the sediment, and the mixture was centrifuged at 8000 rpm for 5 minutes. This washing procedure was repeated twice to remove unreacted precursors and surfactant. The Cu nanocubes were stored in a hydrophobic solvent (for example: hexane, toluene or chloroform) before characterization.

Example III

Synthesis of Cu Nanosheets 6.0 mL of OLA (70%) was loaded into a 25 mL three-neck flask where oxygen was removed through Ar blowing for 20 minutes. Then 1.0 mL of TOP (97%) was injected into the flask under Ar flow. After 20 minutes of Ar flowing, the flask was rapidly heated to 300° C. Next, 2 mL of Cu-TDA complex solution was quickly injected into the hot flask and the reaction solution turned to red. The reaction was held at 300° C. for 3 minutes (at least less than 5 minutes). Then the reaction solution was cooled to room temperature and 5 mL of hexane (or another hydrophobic solvent such as toluene and chloroform) was injected. The products were separated by centrifuging at 10000 rpm for 5 minutes. The supernatant was discarded. 5 mL of hexane was then added to the sediment, and the mixture was centrifuged at 10000 rpm for 5 minutes. The washing procedure was repeated twice to remove unreacted precursors and surfactant. Two-dimensional Cu nanosheets with an average side length of 40 nm and a thickness of 12 nm were stored in a hydrophobic solvent (for example: hexane, toluene or chloroform) before characterization.

Example IV

Characterization of Cu Nanostructures

Figure 12:
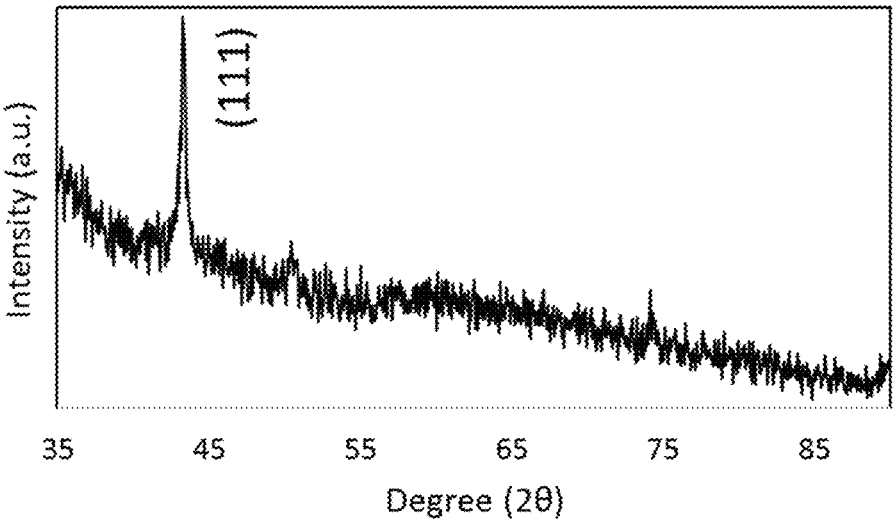
FIG. 12 shows an XRD pattern of copper nanosheets prepared according to Example III.

The surface morphologies of copper nanostructures were investigated using a scanning electron microscope (SEM, QUANTA FEG 650) from FEI with a field emitter as electron source. The SEM images are shown in FIGS. 1-2, 4, and 7-10. A Bruker D8 Advance X-ray diffractometer with Cu Ka radiation operated at a tube voltage of 40 kV and a current of 40 mA was used to obtain X-ray diffraction (XRD) patterns (FIGS. 5 and 12). Transmission electron microscopy (TEM) images were captured using an FEI Tecnai 20 microscope with an accelerating voltage of 200 kV (FIG. 3). The separated gas products were analyzed by a thermal conductivity detector (for $H_2$) and a flame ionization detector (for CO). Liquid products were analyzed by high performance liquid chromatograph (HPLC, Dionex UltiMate 3000 UHPLC+, Thermo Scientific). A UV-Vis-NIR spectrometer (Cary 5000) was used to record the extinction spectra of the Cu nanocubes (FIG. 6).

Electrochemical $CO_2$ reduction experiments (FIG. 13) were conducted using a potentiostat (VersaSTAT MC) in a two-compartment electrochemical cell separated by an anion-exchange membrane (Selemion AMV). A platinum plate counter electrode and a leak-free Ag/AgCI reference electrode (innovative Instruments, diameter: 2.0 mm) were used in a three-electrode configuration. Working electrodes were prepared by drop-casting 800 μg of Cu nanocubes (Cu nanocubes was dispersed in hexanes) onto a glassy carbon electrode (Alfa Aesar: diameter of 1.0 $cm^2$) and drying under argon at room temperature. The working electrode and the counter electrode compartment hold 2.0 mL of electrolyte each, and the working compartment is sealed in order to allow measurements of gas products. All potentials in this work are converted to the RHE scale by E(vs RHE)=E(vs Ag/AgCI)+0.205 V+0.0591×pH. 0.1 M $KHCO_3$ electrolyte was prepared from $K_2CO_3$ saturated with $CO_2$ (pH 7.5).

During electrochemistry, $CO_2$ flowed through the working compartment at a rate of 5 standard cubic centimeters per minute (SCCM). During chronoamperometry, effluent gas from the cell went through the sampling loop of a GC to analyze the concentration of gas products. Quantification of the products was performed with the conversion factor derived from the standard calibration gases. Liquid products were analyzed afterward by HPLC. The concentrations were calculated through the software and are based on calibration curves which we developed for each individual component. Faradaic efficiencies were calculated from the amount of charge passed to produce each product, divided by the total charge passed at a specific time or during the overall run.

What is claimed is:

1. A method for preparing copper nanostructures, the method comprising:

providing a copper complex solution comprising copper and a first complexing agent;

heating a reaction mixture comprising unoxidized tributylphosphine under inert atmosphere;

combining the copper complex solution and the reaction mixture at a reaction temperature under inert atmosphere;

holding the reaction mixture at the reaction temperature for a reaction time under inert atmosphere to form copper nanostructures;

cooling the reaction mixture containing the copper nanostructures; and isolating the copper nanostructures from the reaction mixture, wherein the copper nanostructures comprise copper nanocubes.

2. The method of claim 1, wherein the the reaction temperature is 250 to 350° C., the reaction time is 20 to 40 minutes, and the copper nanocubes have an average size from 30 to 50 nm.

3. The method of claim 2, wherein the reaction temperature is 300° C. and the reaction time is 30 minutes.

4. The method of claim 3, wherein the copper nanocubes have an average size of 38.4±2.7 nm.

5. The method of claim 2, wherein the unoxidized tributylphosphine has a purity of between about 98% and 100%.

6. The method of claim 1, wherein the copper complex solution is provided by heating a mixture comprising copper (I) chloride, tetradecylamine, and 1-octadecene to a temperature from 100 to 300° C. under inert atmosphere for a time from 1 to 60 minutes.

7. The method of claim 6, wherein the temperature is 200° C. and the time is 10 minutes.

8. The method of claim 1, wherein the reaction mixture further comprises a second complexing agent.

9. The method of claim 8, wherein the second complexing agent is oleylamine.

10. The method of claim 1, wherein the copper complex solution is combined with the reaction mixture by injecting the copper complex solution into the reaction mixture under inert atmosphere.

11. The method of claim 1, wherein the copper nanostructures are isolated by centrifugation.

12. The method of claim 1, further comprising injecting a hydrophobic solvent into the reaction mixture during or after the cooling of the reaction mixture and before the isolating of the copper nanostructures.

13. The method of claim 1, further comprising washing the isolated copper nanostructures with a hydrophobic solvent one or more times after the isolating of the copper nanostructures.

* * * * *